US011298804B2

(12) United States Patent
Hsieh

(10) Patent No.: US 11,298,804 B2
(45) Date of Patent: Apr. 12, 2022

(54) PUSHING LEVER STRUCTURE OF RATCHET WRENCH

(71) Applicant: KABO Tool Company, Taichung (TW)

(72) Inventor: Chih-Ching Hsieh, Taichung (TW)

(73) Assignee: KABO Tool Company, Taichung (TW)

( * ) Notice: Subject to any disclaimer, the term of this patent is extended or adjusted under 35 U.S.C. 154(b) by 0 days.

(21) Appl. No.: 17/303,035

(22) Filed: May 19, 2021

(65) Prior Publication Data

US 2021/0370480 A1 Dec. 2, 2021

(30) Foreign Application Priority Data

Jun. 2, 2020 (TW) ..... 109118531

(51) Int. Cl.
*B25B 13/46* (2006.01)

(52) U.S. Cl.
CPC ..... *B25B 13/463* (2013.01); *B25B 13/461* (2013.01); *B25B 13/462* (2013.01)

(58) Field of Classification Search
CPC .... B25B 13/461; B25B 13/462; B25B 13/463
USPC ..... 81/62
See application file for complete search history.

(56) References Cited

U.S. PATENT DOCUMENTS 6,516,690 B2 * 2/2003 Chen ..... B25B 13/463 192/46
6,918,323 B2 * 7/2005 Arnold ..... B25B 13/463 81/63
9,032,845 B2 * 5/2015 Lin ..... B25B 13/463 81/61
9,333,629 B2 * 5/2016 Chen ..... B25B 13/463
9,545,705 B2 * 1/2017 Hu ..... B25B 13/463
10,232,494 B2 * 3/2019 Yang ..... B25B 13/463
10,335,929 B2 * 7/2019 Chou ..... B25B 13/465
2008/0210061 A1 * 9/2008 Yu ..... B25B 13/463 81/58
2013/0228049 A1 * 9/2013 Shen ..... B25B 13/463 81/63.1
2016/0067848 A1 * 3/2016 Lee ..... B25B 13/463 81/63.1
2016/0167203 A1 * 6/2016 Chen ..... B25B 13/463 81/63.1
2019/0337128 A1 * 11/2019 Lee ..... B25B 13/463

* cited by examiner

*Primary Examiner* — Orlando E Aviles
*Assistant Examiner* — Jason Khalil Hawkins
(74) *Attorney, Agent, or Firm* — Wang Law Firm, Inc.

(57) ABSTRACT

A pushing lever structure of a ratchet wrench is provided. The ratchet wrench has a head portion. A ratchet gear, a toothed element, and a pushing lever are mounted in a receiving space of the head portion. A rear peripheral surface portion of the toothed element is provided with a recess. A pushing block extending forward from the pushing lever extends into the recess of the toothed element. When rotated, the pushing lever can move the toothed element effectively because it is the pushing block of the pushing lever that drives the toothed element into displacement. The bottom side of the head portion is mounted with a cover plate, and the bottom end of the pushing lever is pivotally provided on the cover plate to enhance the rotation stability of the pushing lever.

6 Claims, 11 Drawing Sheets

PUSHING LEVER STRUCTURE OF RATCHET WRENCH

BACKGROUND OF THE INVENTION

1. Technical Field

The present invention relates to a hand tool and more particularly to a pushing lever structure of a ratchet wrench.

2. Description of Related Art

A ratchet wrench configured to be rotated in two directions has a pushing lever with which to change the rotation direction of the ratchet wrench. By operating the pushing lever, the rotation direction of the ratchet gear of the ratchet wrench can be changed.

Taiwan Invention Patent No. I228441 discloses a ratchet wrench (ratcheting tool) that includes a pushing lever 122 and a toothed element 94. The pushing lever 122 is rotatably mounted in a cylindrical compartment 24 of the wrench. The toothed element 94 is mounted in a receiving chamber 16 of the wrench along with a ratchet gear 48. A pusher 138 and a spring 136 are mounted in a blind bore 134 in a front peripheral surface portion of the pushing lever 122. The front end of the pusher 138 extends into a pocket 104 of the toothed element 94 and is driven by the elastic force of the spring 136 to push the toothed element 94 forward such that the teeth 102 on a front peripheral surface portion of the toothed element 94 mesh with the corresponding teeth 52 of the ratchet gear 48. When the pushing lever 122 is rotated, the toothed element 94 is driven toward the left or right side of the wrench by the pushing lever 122 through the pusher 138 and the spring 136 until elastically biased to the left or right side of the receiving chamber 16. Consequently, a left or right portion of the toothed element 94 is brought into a meshing relationship with the ratchet gear 48 to change the operating direction of the ratchet wrench (e.g., from clockwise to counterclockwise).

In the conventional ratchet wrench cited above, the toothed element 94 is driven to displace toward the left or right side of the receiving chamber 16 by the pushing lever 122 through the pusher 138 and the spring 136. As the assembly of the pusher 138 and the spring 136 is an elastic one and bends easily, the pushing lever 122 may fail to displace the toothed element 94 effectively.

Moreover, the bottom of the pushing lever 122 has a forward extending lip 144 and a rearward extending lip 145. The forward extending lip 144 extends into a curved notch 118 in a bottom portion of the toothed element 94, and the rearward extending lip 145 extends into a groove in a bottom portion of the compartment 24, such that the pushing lever 122 is retained in the compartment 24. While the two lips 144 and 145 can prevent the pushing lever 122 from moving out of the compartment 24 and also contribute to the rotation stability of the pushing lever 122, the foregoing structures for ensuring the rotation stability of the pushing lever 122 are rather complicated, difficult to manufacture, and still unable to produce a satisfactory stabilizing effect.

Furthermore, the conventional ratchet wrench cited above uses the elastic extension of the spring 136 as the positioning mechanism of the pushing lever 122. In other words, the pusher 138 and the spring 136 function as positioning elements as well as driving elements and are used not only as the means by which the pushing lever 122 drives the toothed element 94 into displacement, but also to keep the pushing lever 122 in position. This arrangement, however, may fail to position the pushing lever 122, and hence the toothed element 94, effectively, resulting in a poor meshing relationship between the toothed element 94 and the ratchet gear 48.

BRIEF SUMMARY OF THE INVENTION

The present invention aims to solve the aforesaid problems, the primary objective being to provide a pushing lever structure of a ratchet wrench so that the pushing lever of a ratchet wrench can drive a toothed element into displacement with enhanced stability.

Another objective of the present invention is to provide a pushing lever structure of a ratchet wrench so that the pushing lever of a ratchet wrench not only can be rotated stably, but also has a simpler structure than its prior art counterparts.

Yet another objective of the present invention is to provide a pushing lever structure of a ratchet wrench so that the pushing lever of a ratchet wrench can be securely retained at its operating positions.

The present invention provides a pushing lever structure of a ratchet wrench, wherein the pushing lever structure includes a head portion, a ratchet gear, a toothed element, a pushing lever, and an elastic positioning element. The head portion is formed with a receiving space. The ratchet gear is mounted in the receiving space of the head portion and can be rotated. The toothed element has a recess provided in a rear peripheral surface portion of the toothed element, is mounted in the receiving space, and can be displaced between two opposite lateral sides of the receiving space. The pushing lever has a main body, a pushing portion provided at the top end of the main body, and a pushing block extending forward from the main body. The pushing lever is mounted in the receiving space and can be rotated. The pushing portion juts out of the head portion. The pushing block extends into the recess of the toothed element and can push, and thereby displace, the toothed element when the pushing lever is rotated. The elastic positioning element is provided between the rear side of the toothed element and the front side of the pushing lever and has such elasticity as to urge the teeth on the front side of the toothed element to stay meshing with the corresponding teeth of the ratchet gear.

As the toothed element is driven into displacement by the pushing lever through the inflexible pushing block, the stability with which the pushing lever displaces the toothed element is enhanced in comparison with the prior art.

Preferably, the pushing block of the pushing lever has a width that is gradually reduced toward the free end of the pushing block, and the distance between two opposite lateral sides of the recess is gradually increased from the inner end of the recess toward the opening of the recess.

Preferably, the pushing block has two curved opposite lateral sides, and the two opposite lateral sides of the recess are also curved to enable a smooth contact between the pushing block and either of the two opposite lateral sides of the recess.

Preferably, the receiving space has a hollow bottom side, a cover plate is mounted at the bottom side of the head portion to close the receiving space, and the bottom end of the pushing lever is pivotally provided on the cover plate such that the pushing lever has a supporting pivot that enhances the rotation stability of the pushing lever.

Preferably, an elastic positioning element is provided at the rear side of the pushing lever and is configured to push elastically against a rear peripheral surface portion of the receiving space and thereby secure the pushing lever in position.

BRIEF DESCRIPTION OF THE SEVERAL VIEWS OF THE DRAWINGS

The objectives, features, and intended effects of the present invention can be better understood by referring to the following detailed description of a preferred embodiment of the invention in conjunction with the accompanying drawings, in which.

DETAILED DESCRIPTION OF THE INVENTION

Figure 1:
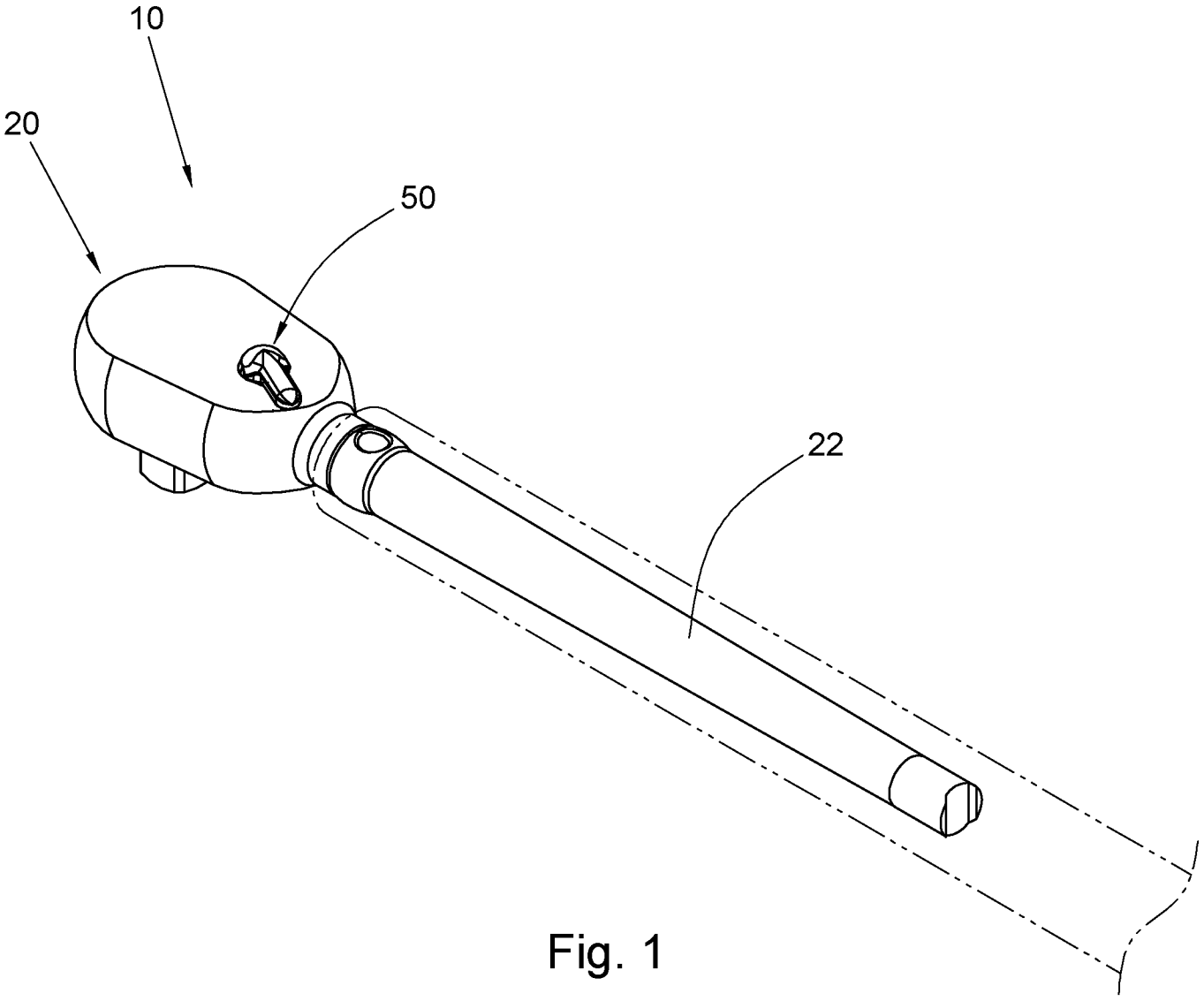
FIG. 1 is a perspective view of the ratchet wrench according to a preferred embodiment of the invention.
Figure 2:
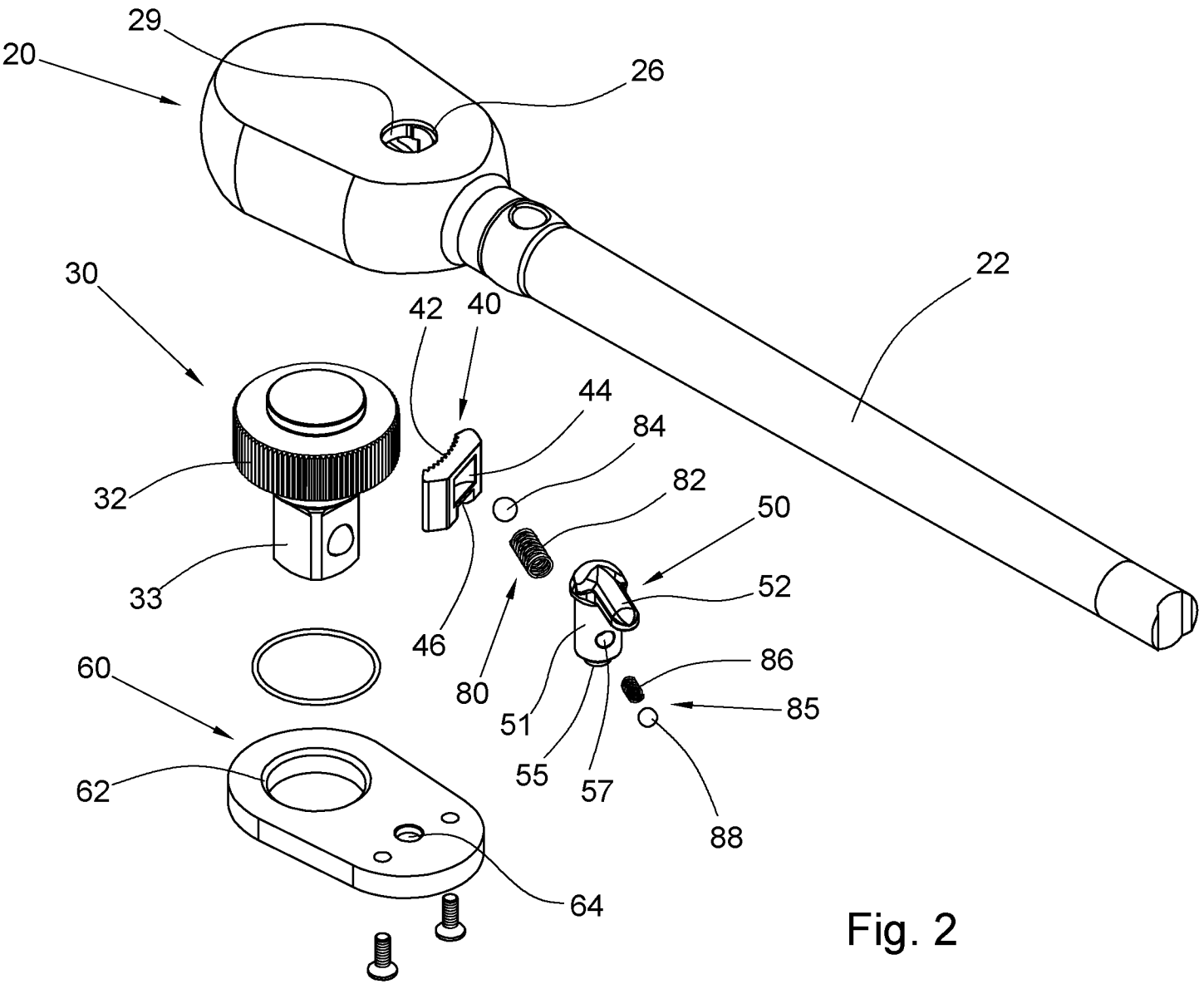
FIG. 2 is an exploded perspective view of the ratchet wrench in FIG. 1.
Figure 3:
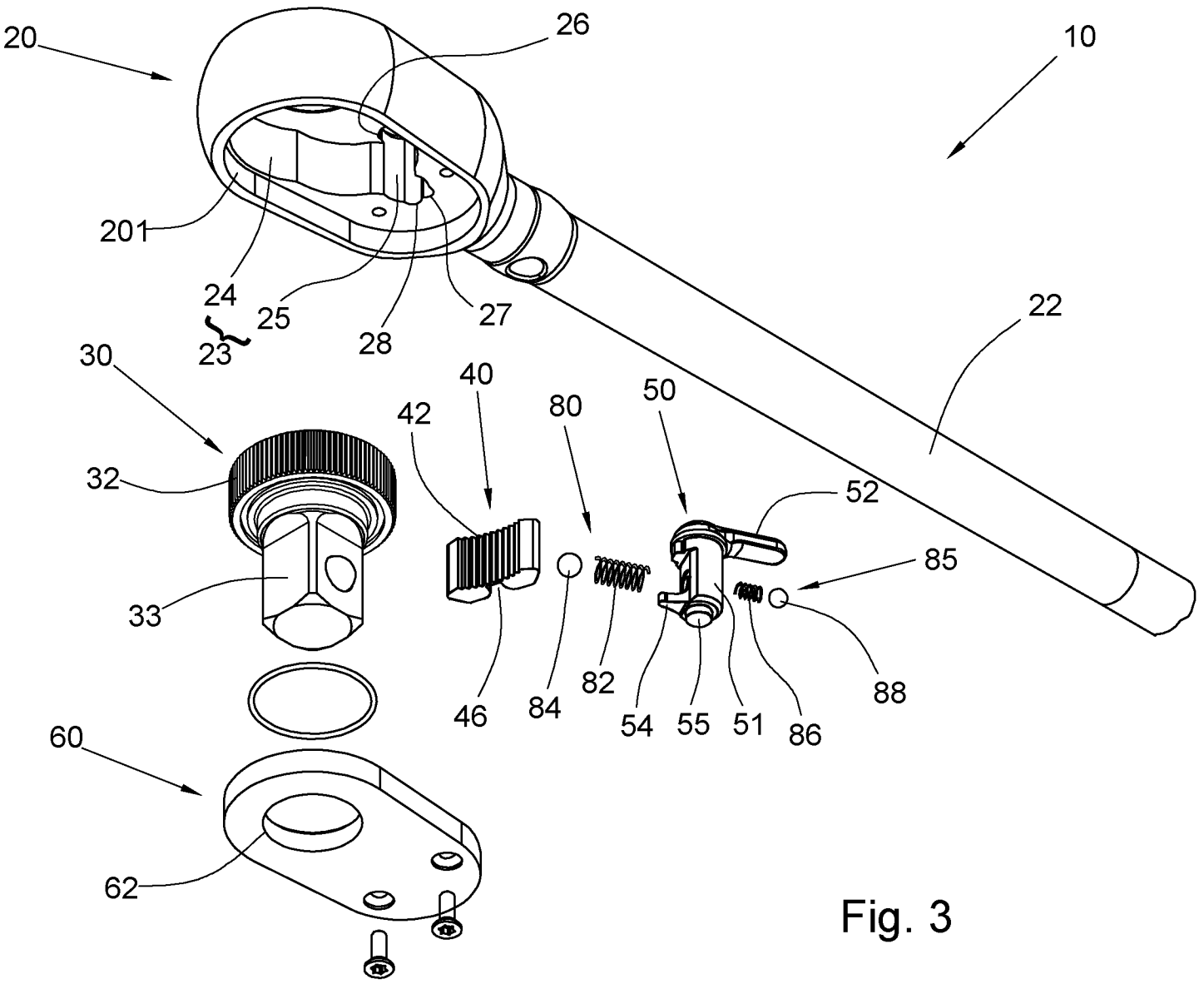
FIG. 3 is an exploded perspective bottom view of the ratchet wrench in FIG. 1.

Please refer to FIG. 1 to FIG. 3 for the pushing lever structure of a ratchet wrench as provided by a preferred embodiment of the present invention, wherein the pushing lever structure includes a head portion of a ratchet wrench. In the preferred embodiment shown in FIG. 1, the ratchet wrench 10 includes a head portion 20 and a shaft 22 connected to the rear end of the head portion 20. The ratchet wrench 10 may be a wrench configured to be used independently (in which case the shaft 22 serves as a handle), or the ratchet wrench 10 may be a part of a ratcheting torque wrench whose torque is adjustable (in which case the shaft 22 extends into and is pivotally connected to a tube as indicated by the dashed lines in FIG. 1). The features of the invention consist in structures related to a pushing lever; structures that are not related to the pushing lever are not the subject matter of the invention and therefore will not be detailed herein.

Figure 7:
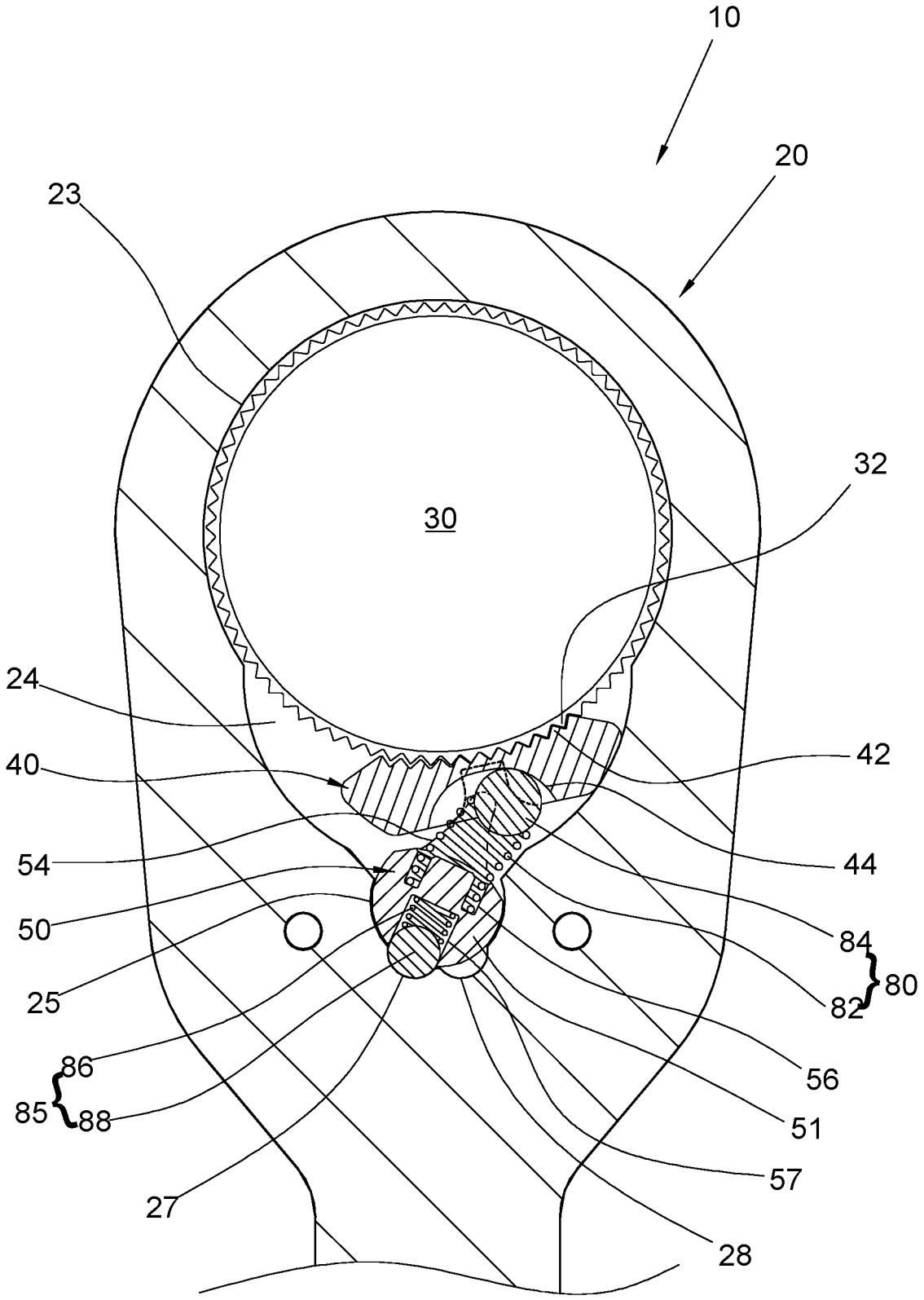
FIG. 7 is a sectional view taken along line 7-7 in FIG. 5, showing that the pushing lever and the toothed element are retained at the first position.

The ratchet wrench 10 includes a ratchet gear 30, a toothed element 40, a pushing lever 50, and a cover plate 60 in addition to the head portion 20. A receiving space 23 for receiving the ratchet gear 30, the toothed element 40, and the pushing lever 50 is provided in the head portion 20 and includes a front receiving chamber 24 and a rear receiving chamber 25 in communication with the front receiving chamber 24. The bottom side of the head portion 20 is provided with an opening 201 in communication with the receiving space 23 such that the bottom side of the receiving space 23 is hollow. A through hole 26 is provided in the top wall of the head portion 20 and is in communication with the rear receiving chamber 25. Referring to FIG. 7, a rear peripheral wall portion of the rear receiving chamber 25 is provided with a first positioning portion 27 and a second positioning portion 28, wherein the two positioning portions 27 and 28 are respectively and symmetrically located on two opposite lateral sides of the rear receiving chamber 25. A position-limiting groove 29 is concavely provided in the wall of the through hole 26 and has an appropriate arc length. The two ends of the position-limiting groove 29 are both stop points.

Figure 5:
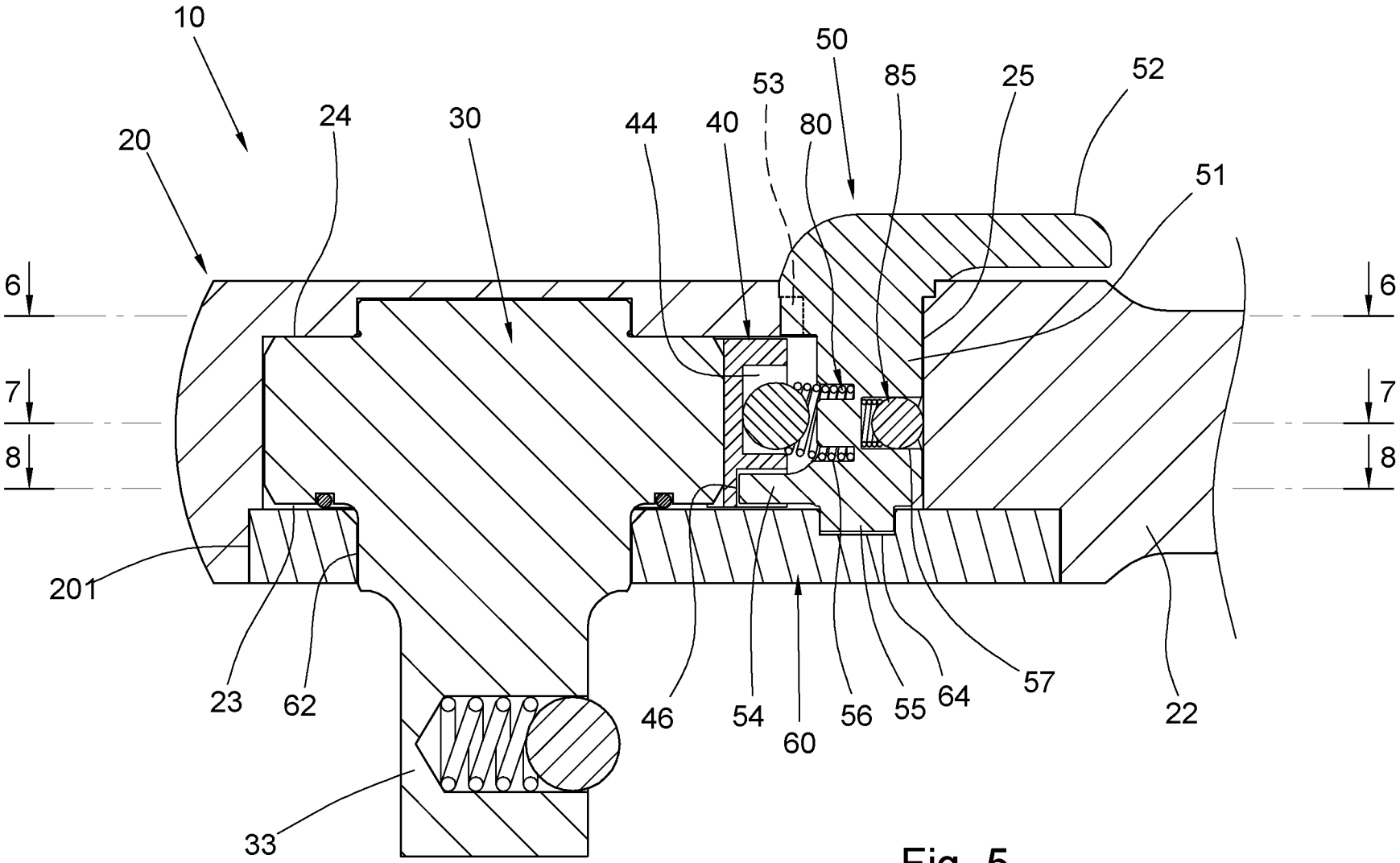
FIG. 5 is a longitudinal sectional view of the ratchet wrench in FIG. 1.

Referring to FIG. 5 and FIG. 7, the ratchet gear 30, the toothed element 40, and the pushing lever 50 are mounted, and sequentially arranged in a front-to-rear direction, in the receiving space 23 of the head portion 20. The ratchet gear 30 can be rotated in the front receiving chamber 24. The ratchet gear 30 may be protrudingly provided with an insertion post 33 or be provided with a polygonal mounting hole so as to drive a socket or a threaded fastener (e.g., a bolt or a nut).

Figure 4:
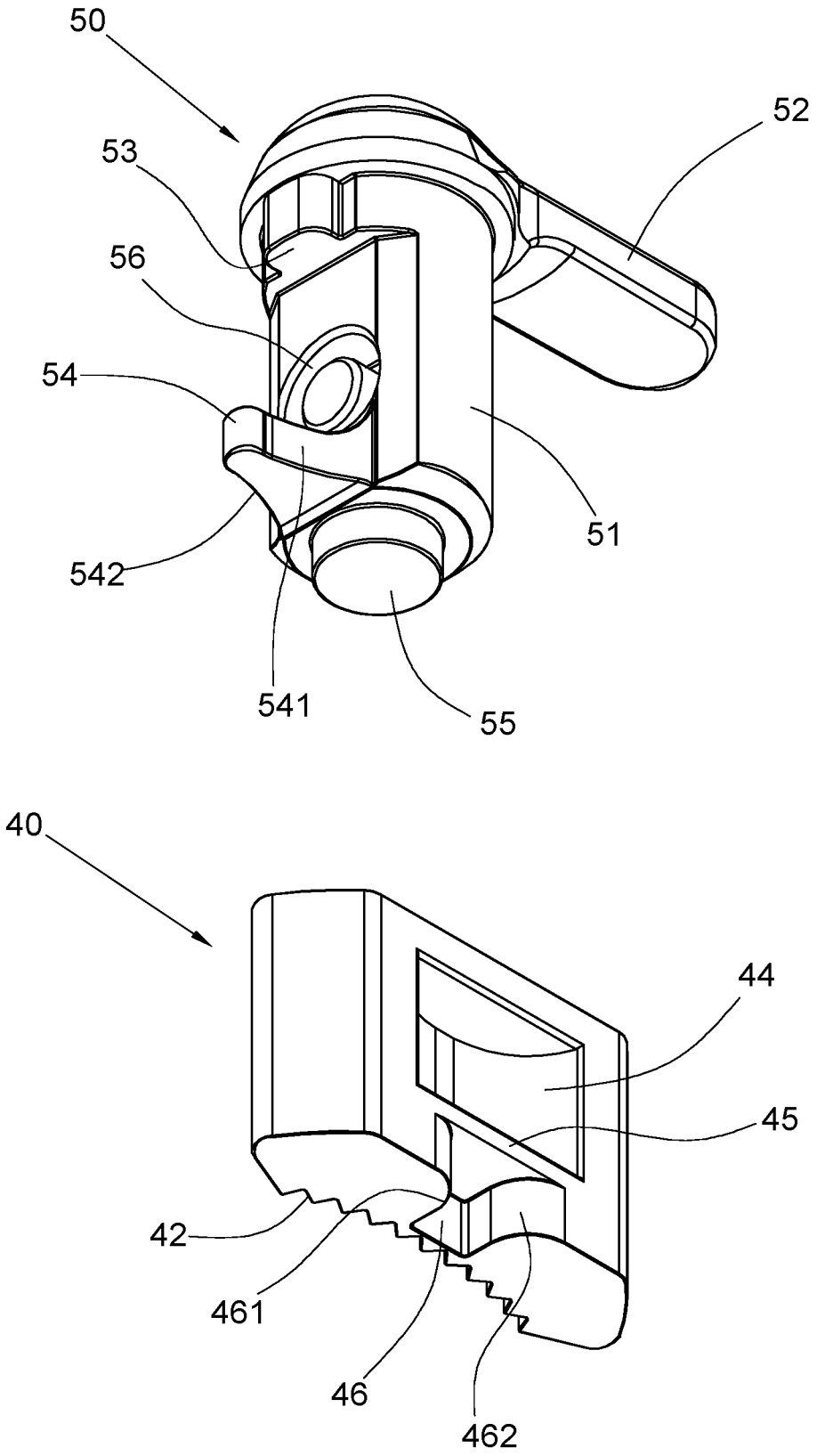
FIG. 4 is a perspective bottom view of the pushing lever and of the toothed element in the ratchet wrench in FIG. 1.

The toothed element 40 can be displaced between two opposite lateral sides of the front receiving chamber 24. The front end face of the toothed element 40 has a plurality of teeth 42 configured to mesh with the teeth 32 provided on the peripheral surface of the ratchet gear 30. Referring to FIG. 4, a rear peripheral surface portion of the toothed element 40 is provided with a curved-walled cavity 44 and a recess 46, which are vertically arranged with respect to each other, with the cavity 44 located above the recess 46. While the cavity 44 and the recess 46 may be in communication with each other, they are separated by a partition plate 45 in this preferred embodiment. The cavity 44 has a greater width than the recess 46. The two opposite lateral sides of the recess 46 are formed as outwardly curved, i.e., convex, surfaces and are defined as a first convex surface 461 and a second convex surface 462 respectively. The two convex surfaces 461 and 462 are so designed that they become father apart in a curved manner as they extend outward. In other words, the distance between the two opposite lateral sides of the recess 46 (i.e., the distance between the two convex surfaces 461 and 462) is gradually increased outward and is greater at the opening of the recess 46 than at the inner end of the recess 46.

Figure 8:
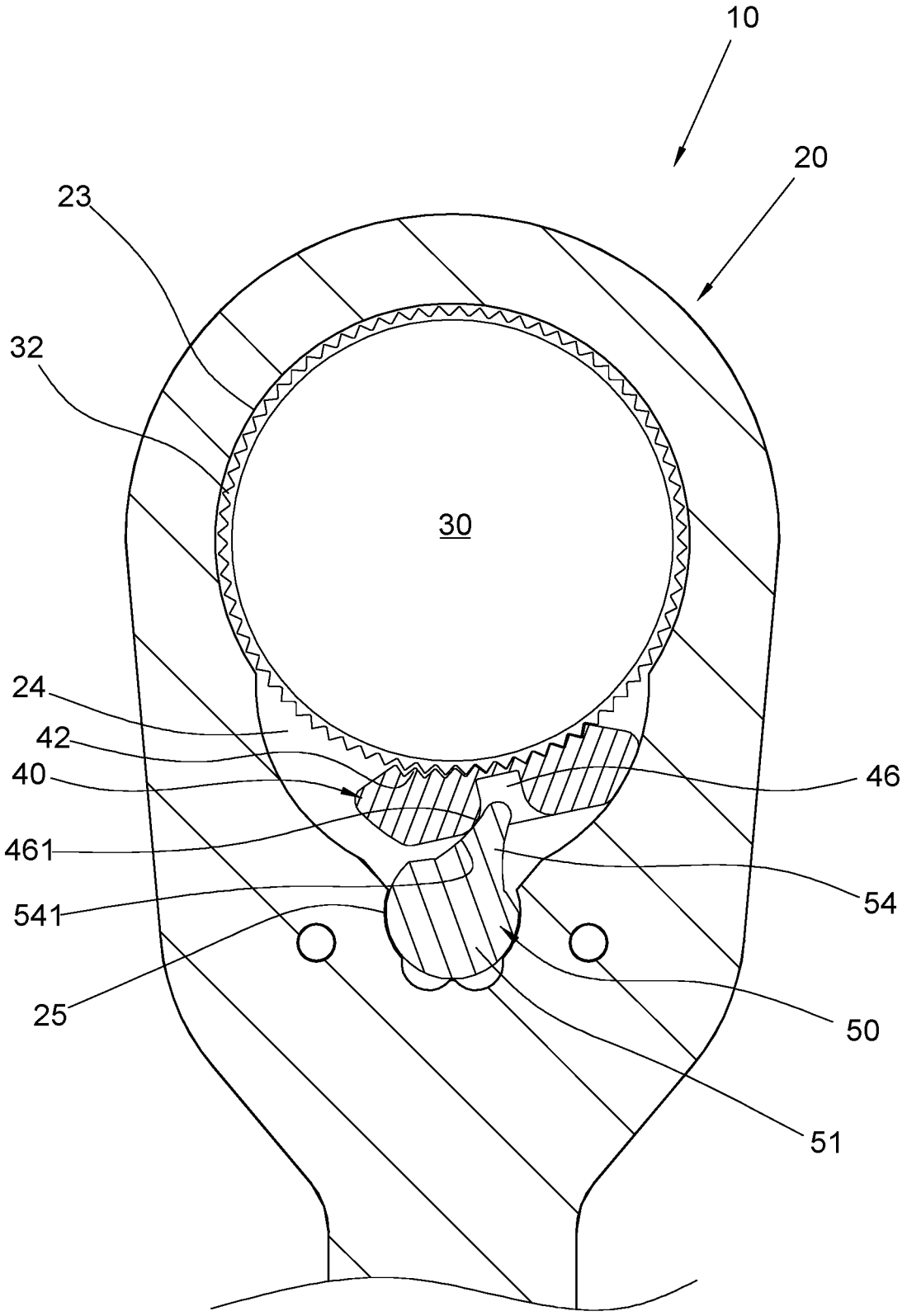
FIG. 8 is a sectional view taken along line 8-8 in FIG. 5, showing the working relationship between the pushing lever and the toothed element at the first position.

The pushing lever 50 has a main body 51, a pushing portion 52 provided at the top end of the main body 51, and a pushing block 54 extending forward from a bottom portion of the main body 51 and preferably having a width that is gradually reduced toward the free end of the pushing block 54. The pushing block 54 has two opposite lateral sides formed as inwardly curved, or concave, surfaces 541 and 542 respectively. A shaft portion 55 is provided at the bottom side of the main body 51 and functions as the rotation axis of the pushing lever 50. A protruding portion 53 is protrudingly provided on the peripheral surface of a top portion of the main body 51. The pushing lever 50 is mounted into the head portion 20 through the through hole 26 of the head portion 20 such that the main body 51 is mounted in the rear receiving chamber 25 in a rotatable manner. The pushing portion 52 juts out of the head portion 20. The pushing block 54 extends into the recess 46 in the rear end face of the toothed element 40 so that when the pushing lever 50 is rotated, referring to FIG. 8, the pushing block 54 can drive the toothed element 40 into displacement. The protruding portion 53 of the pushing lever 50 extends into the position-limiting groove 29 of the head portion 20.

An elastic pushing element 80 is formed by a compression spring 82 and a ball 84 and has its two opposite ends mounted respectively in the cavity 44 in the rear end face of the toothed element 40 and a hole 56 in a front peripheral surface portion of the main body 51 of the pushing lever 50. The elastic pushing element 80 exerts an elastic force that urges the toothed element 40 to stay meshing elastically with the ratchet gear 30.

An elastic positioning element 85 is also formed by a compression spring 86 and a ball 88 and has one end mounted in a hole 57 in a rear peripheral surface portion of the main body 51 of the pushing lever 50 and the opposite end elastically coupled to one of the two positioning portions 27 and 28 such that the pushing lever 50 is retained at a first position or a second position, as explained further below.

The cover plate 60 covers the opening 201 of the head portion 20 in a detachable manner achieved with a threaded fastener or other means, and the receiving space 23 is thus sealed by the cover plate 60. The cover plate 60 has a hole 62 through which the insertion post 33 of the ratchet gear 30 extends. The cover plate 60 is provided with a pivotal connection portion 64, and the shaft portion 55 of the pushing lever 50 is pivotally connected to the pivotal connection portion 64. The position where the shaft portion 55 and the pivotal connection portion 64 are pivotally connected defines the center of rotation of the pushing lever 50. It should be understandable that the shaft portion 55 and the pivotal connection portion 64 are of matching configurations that involve a recess (e.g., a hole) and a protuberance (e.g., a protruding part); that is to say, one of the shaft portion 55 and the pivotal connection portion 64 has a recessed configuration, and the other has a protruding configuration. For example, the shaft portion 55 may be formed as a circular projection while the pivotal connection portion 64 is a circular hole, or the shaft portion 55 may be formed as a circular hole while the pivotal connection portion 64 is a circular projection.

Figure 6:
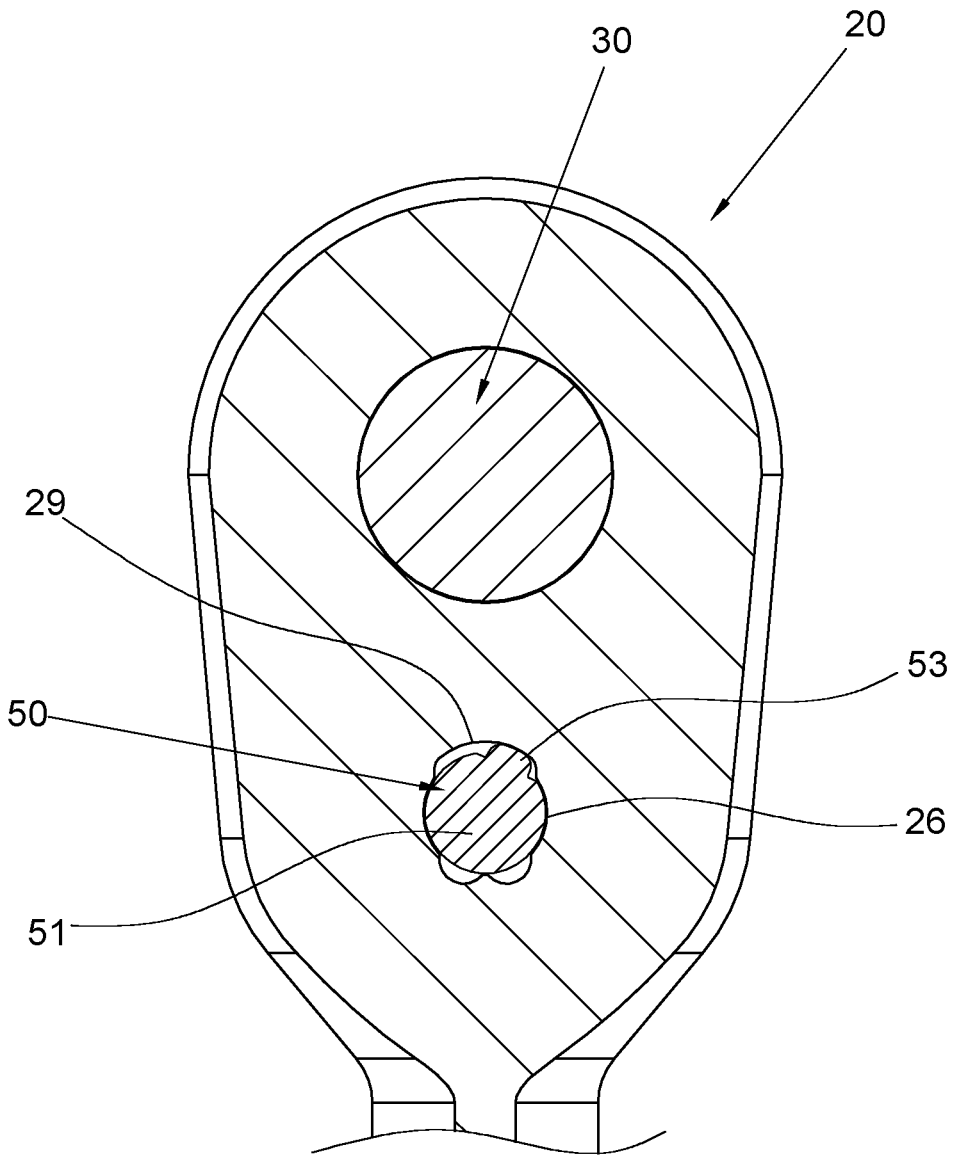
FIG. 6 is a sectional view taken along line 6-6 in FIG. 5, showing that the pushing lever has been switched to a first position.

The use method of the present invention and the working relationships between the components of the invention are described as follows, in which terms such as clockwise, counterclockwise, left, and right make reference to the directions presented in the accompanying drawings. When the pushing lever 50 is rotated clockwise, the pushing block 54 of the pushing lever 50 pushes the toothed element 40 toward the right side of the front receiving chamber 24; as a result, the pushing lever 50 and the toothed element 40 are displaced to the first position shown in FIG. 6 to FIG. 8. More specifically, referring to FIG. 6, the protruding portion 53 is stopped by the right end of the position-limiting groove 29 when the pushing lever 50 is rotated clockwise, meaning the right end of the position-limiting groove 29 is a rotation stop point of the pushing lever 50. When the protruding portion 53 is so stopped, referring to FIG. 7, the toothed element 40 has been driven by the pushing block 54 to lie against the right wall of the front receiving chamber 24, and the elastic positioning element 85 is elastically coupled to the first positioning portion 27 such that the pushing lever 50 is held at the first position. Meanwhile, the elastic pushing element 80 keeps the toothed element 40 and the ratchet gear 30 in a meshing relationship. When the wrench 10 is rotated clockwise in this state, the toothed element 40 stays meshing with the ratchet gear 30 and can therefore drive the ratchet gear 30 into clockwise rotation. If, however, the wrench 10 is rotated counterclockwise, the toothed element 40 will jump on the periphery of the ratchet gear 30 such that the wrench 10 cannot drive the ratchet gear 30 into rotation effectively.

Figure 9:
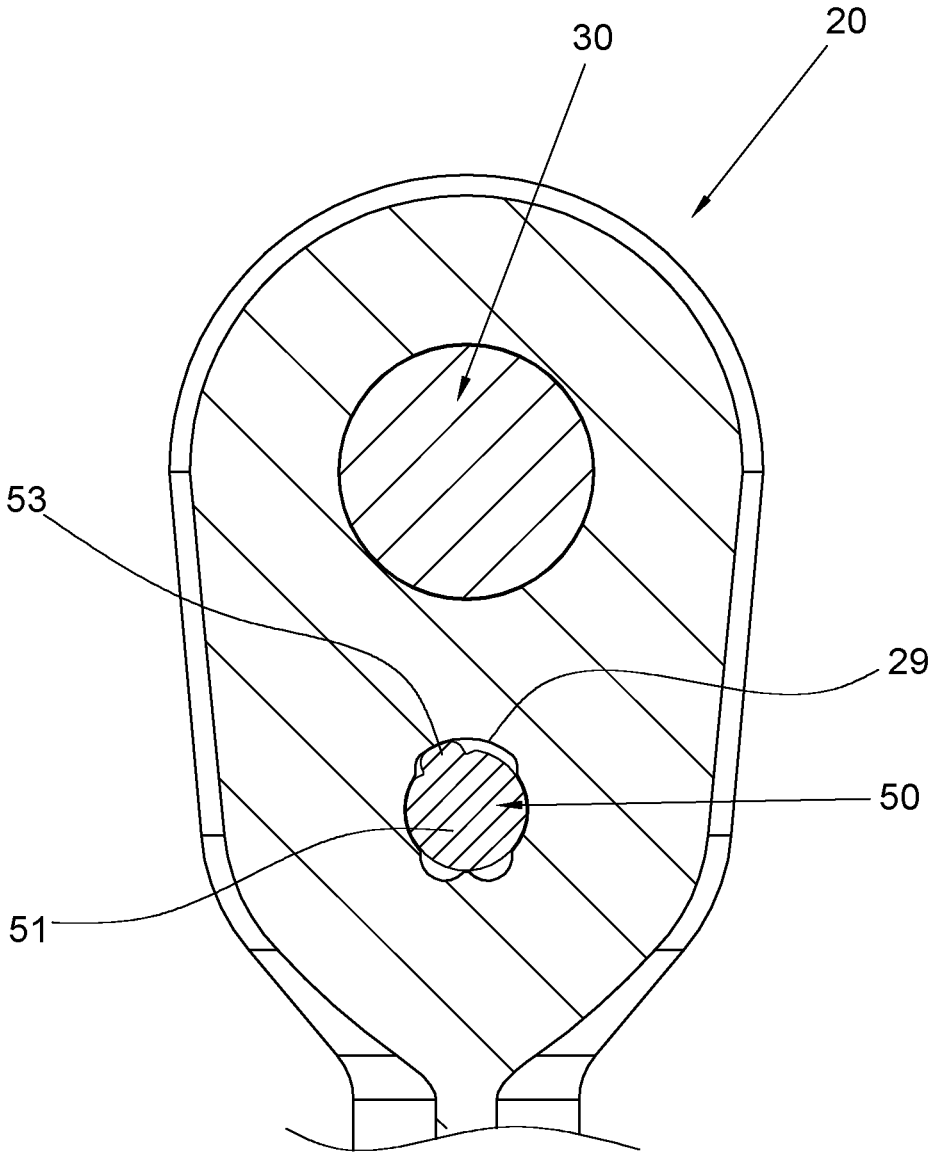
FIG. 9 is similar to FIG. 6 except that the pushing lever has been switched to a second position.
Figure 10:
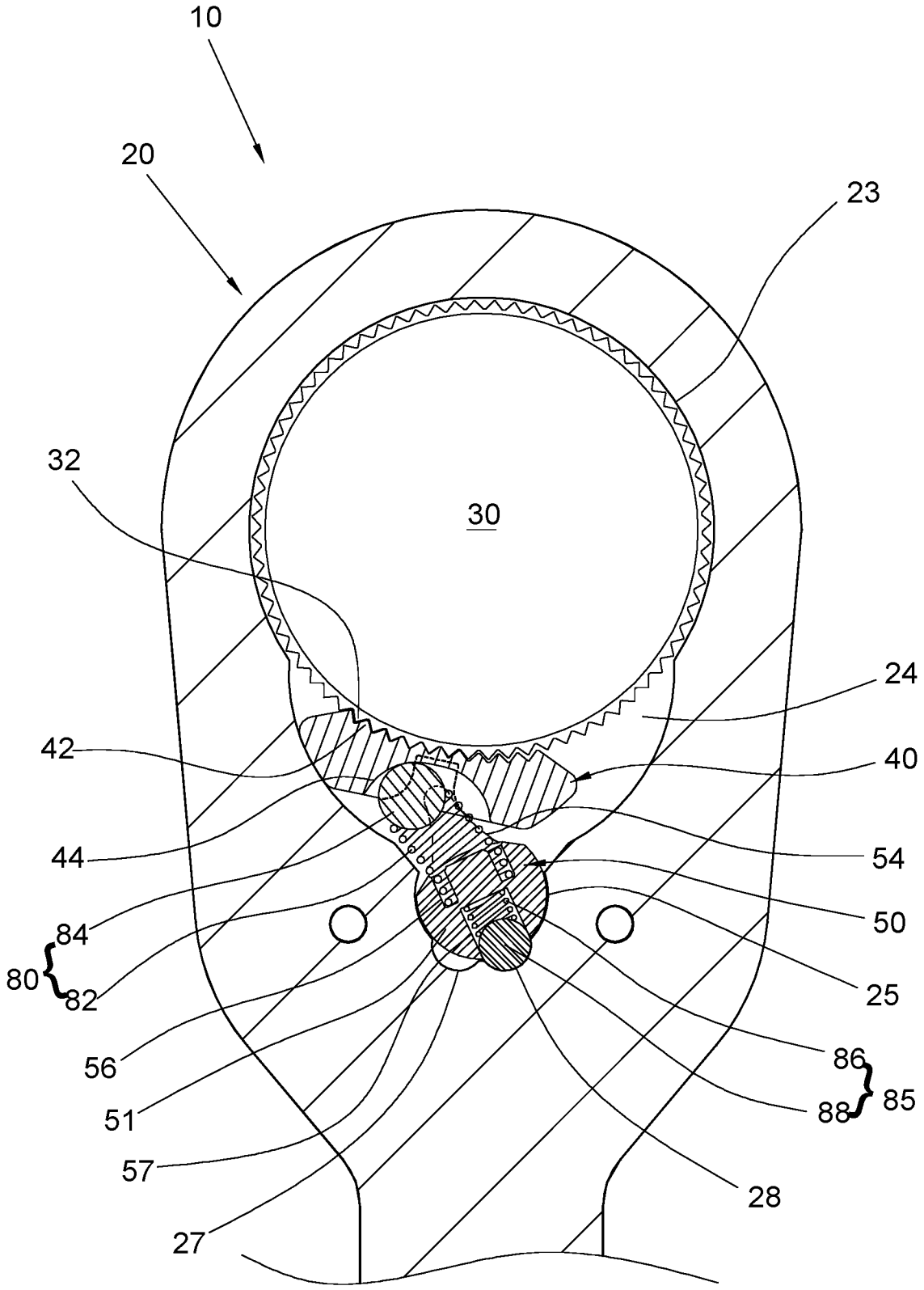
FIG. 10 is similar to FIG. 7 except that the pushing lever has been switched to the second position.
Figure 11:
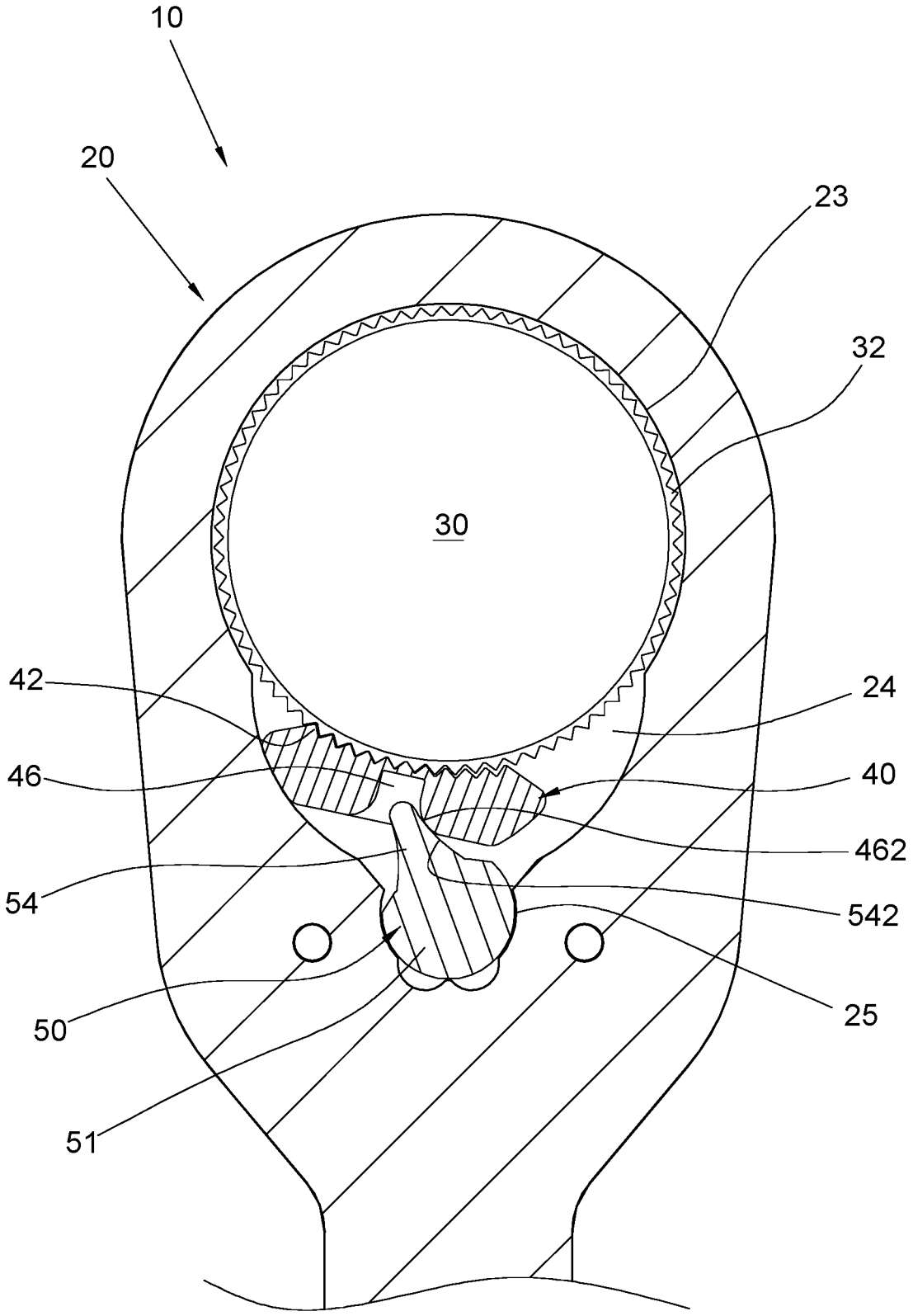
FIG. 11 is similar to FIG. 8 except that the pushing lever and the toothed element are retained at the second position

When the pushing lever 50 is rotated counterclockwise, the pushing lever 50 and the toothed element 40 are displaced to the second position shown in FIG. 9 to FIG. 11, with the protruding portion 53 of the pushing lever 50 stopped by the left end of the position-limiting groove 29 as shown in FIG. 9, meaning the left end of the position-limiting groove 29 is also a rotation stop point of the pushing lever 50. When the protruding portion 53 is so stopped, referring to FIG. 8, the toothed element 40 has been driven leftward by the pushing lever 50 from the first position, with the left concave surface 541 of the pushing block 54 of the pushing lever 50 in stable contact with the first convex surface 461 on the left side of the recess 46 of the toothed element 40, and in the course in which the pushing lever 50 is rotated counterclockwise and pushes the toothed element 40 leftward, the concave surface 541 of the pushing block 54 and the convex surface 461 of the recess 46 remain in substantial and smooth contact with each other to allow the pushing lever 50 to drive the toothed element 40 leftward effectively without making any unwanted action.

Once the pushing lever 50 and the toothed element 40 reach the second position shown in FIG. 10 and FIG. 11, the toothed element 40 lies against the left wall of the front receiving chamber 24, and the elastic positioning element 85 has left the first positioning portion 27 and is elastically coupled to the second positioning portion 28 to hold the pushing lever 50 at the second position. In the meantime, the elastic pushing element 80 keeps the toothed element 40 meshing with the ratchet gear 30. When the wrench 10 is rotated counterclockwise in this state, the ratchet gear 30 can be driven into counterclockwise rotation, but if the wrench 10 is rotated clockwise, the toothed element 40 will jump on the periphery of the ratchet gear 30, making it impossible to rotate the ratchet gear 30 effectively with the wrench 10.

When it is desired to switch the pushing lever 50 and the toothed element 40 from the second position back to the first position, the pushing lever 50 is rotated clockwise so that, with the right concave surface 542 of the pushing block 54 of the pushing lever 50 in contact whit the second convex surface 462 on the right side of the recess 46 of the toothed element 44 as shown in FIG. 11, the pushing block 54 can drive the toothed element 40 rightward. During the process, the concave surface 542 of the pushing block 54 and the convex surface 462 of the recess 46 will remain in substantial and smooth contact with each other to allow the pushing lever 50 to drive the toothed element 40 rightward effectively without making any unwanted action.

The ratchet wrench provided by the present invention is so designed that the pushing lever 50 uses the pushing block 54, which is inflexible, to drive the toothed element 40 into displacement and can therefore displace the toothed element 40 in an effective and stable manner. Moreover, with the configuration of the pushing block 54 (which gradually tapers toward its free end) matching that of the recess 46 (which gradually widens from the inner end toward the opening), and the concave surfaces 541 and 542 of the pushing block 54 matching the convex surfaces 461 and 462 of the recess 46, effective and stable contact between the pushing block 54 and either lateral side of the recess 46 can be achieved while the pushing lever 50 and the toothed element 40 are displaced through a large angle.

The shaft portion 55 at the bottom end of the pushing lever 50 is pivotally connected to the pivotal connection portion 64 of the cover plate 60 such that the pushing lever 50 has a stable supporting pivot that provides the pushing lever 50 with high rotation stability. Furthermore, the supporting pivot of the pushing lever 50 is structurally simple and can be produced with ease.

The elastic pushing element 80 serves only to push the toothed element 40 elastically. It is the elastic positioning element 85 that keeps the pushing lever 50 at the first position or the second position. Therefore, the pushing lever 50, and consequently the toothed element 40, can be effectively retained at their operating positions to ensure that the toothed element 40 and the ratchet gear 30 stay meshing with each other stably.

When the pushing lever 50 is rotated, its position is limited by the position-limiting groove 29. This makes it possible to rotate the pushing lever 50 accurately to either one of the first position and the second position.

The pushing lever structure provided by the present invention is indeed capable of enhancing the convenience of use of a reversible ratchet wrench and therefore provides an improvement in functionality. The embodiment described above serves only to explain the technical features of the invention but not to limit the scope of the invention. Any equivalent changes based on the concept of the invention shall fall within the scope of patent protection of the invention.

What is claimed is:

1. A pushing lever structure of a ratchet wrench, comprising:

a head portion formed with a receiving space and having a through hole in a top wall of the head portion, wherein the through hole is in communication with the receiving space;

a ratchet gear having a peripheral surface provided with teeth, the ratchet gear being rotatably mounted in the receiving space of the head portion;

a toothed element having a front peripheral surface portion provided with teeth, the toothed element further having a rear peripheral surface portion provided with a cavity and a recess, wherein the cavity and the recess are vertically arranged with respect to each other, the cavity has a greater horizontal width than the recess, the toothed element being mounted in the receiving space and displaceable between two opposite lateral sides of the receiving space;

a pushing lever having a main body, a pushing portion provided at a top end of the main body, and a pushing block extending forward from the main body, the pushing lever being rotatably mounted in the receiving space, wherein the pushing portion juts out of the head portion through the through hole, the pushing block extends into the recess of the toothed element, and the pushing block drives the toothed element into displacement when the pushing lever is rotated; and an elastic positioning element provided between a rear side of the toothed element and a front side of the pushing lever, the elastic positioning element having a front end extending into the cavity of the toothed element, the elastic positioning element having such elasticity as to urge a front side of the toothed element to keep meshing with the ratchet gear;

wherein the pushing block has a width gradually reduced toward a free end of the pushing block, the pushing block has two curved opposite lateral sides, each of the two opposite lateral sides of the pushing block forms a concave surface, and the recess has two opposite lateral sides spaced farther apart at an opening of the recess than at an inner end of the recess, the two opposite lateral sides of the recess are curved, and each of the two opposite lateral sides of the recess forms a convex surface.

2. The pushing lever structure of claim 1, wherein the cavity is located above the recess, and the pushing block is located at a bottom portion of the main body of the pushing lever.

3. The pushing lever structure of claim 1, wherein the receiving space has a hollow bottom side, a cover plate is mounted at a bottom side of the head portion to close the receiving space, and the pushing lever has a bottom end pivotally provided on the cover plate.

4. The pushing lever structure of claim 3, further comprising a shaft portion provided at the bottom end of the pushing lever and a pivotal connection portion provided on the cover plate, wherein the shaft portion of the pushing lever is pivotally connected to the pivotal connection portion of the cover plate.

5. The pushing lever structure of claim 1, wherein the pushing lever is rotatable between a first position and a second position, a first positioning portion and a second positioning portion are provided at a rear peripheral wall portion of the receiving space, an elastic positioning element is provided at a rear side of the pushing lever, the elastic positioning element is elastically coupled to the first positioning portion when the pushing lever is at the first position, and the elastic positioning element is elastically coupled to the second positioning portion when the pushing lever is at the second position.

6. The pushing lever structure of claim 1, further comprising a protruding portion and a position-limiting groove, wherein the protruding portion and the position-limiting groove are provided between a wall of the through hole of the head portion and a peripheral surface of the main body of the pushing lever, the protruding portion extends into the position-limiting groove, and the pushing lever reaches a rotation stop point when the protruding portion contacts either of two opposite ends of the position-limiting groove.

* * * * *